US008584583B2

(12) United States Patent
Bohr

(10) Patent No.: US 8,584,583 B2
(45) Date of Patent: Nov. 19, 2013

(54) SCREEN PRINTING METHOD FOR APPLYING A DESIGN ON A GROUND SURFACE

(76) Inventor: Jeffrey S. Bohr, Louisville, KY (US)

( * ) Notice: Subject to any disclaimer, the term of this patent is extended or adjusted under 35 U.S.C. 154(b) by 0 days.

(21) Appl. No.: 13/330,350

(22) Filed: Dec. 19, 2011

(65) Prior Publication Data

US 2012/0318153 A1 Dec. 20, 2012

Related U.S. Application Data

(63) Continuation of application No. 11/607,755, filed on Nov. 30, 2006.

(60) Provisional application No. 60/790,898, filed on Apr. 11, 2006.

(51) Int. Cl.

| | |
|---|---|
| ***B41M 1/12*** | (2006.01) |
| ***B41F 15/34*** | (2006.01) |
| *G09F 19/22* | (2006.01) |
| *A63C 19/02* | (2006.01) |

(52) U.S. Cl.
USPC ..... 101/129; 101/127; 434/87

(58) Field of Classification Search
None
See application file for complete search history.

(56) References Cited

U.S. PATENT DOCUMENTS

| | | | | |
|---|---|---|---|---|
| 2005/0229421 | A1 * | 10/2005 | Deas et al. | 33/563 |
| 2006/0130679 | A1 * | 6/2006 | DuBois, III | 101/128.4 |
| 2007/0095220 | A1 * | 5/2007 | Cox et al. | 101/127 |

* cited by examiner

*Primary Examiner* — Leslie J Evanisko
(74) *Attorney, Agent, or Firm* — Lech Law, LLC; Robert R. Lech

(57) ABSTRACT

Screen printing systems and methods are disclosed. The disclosed systems and methods enable a user to employ a screen printing process to decorate a non-traditional surface.

7 Claims, 1 Drawing Sheet

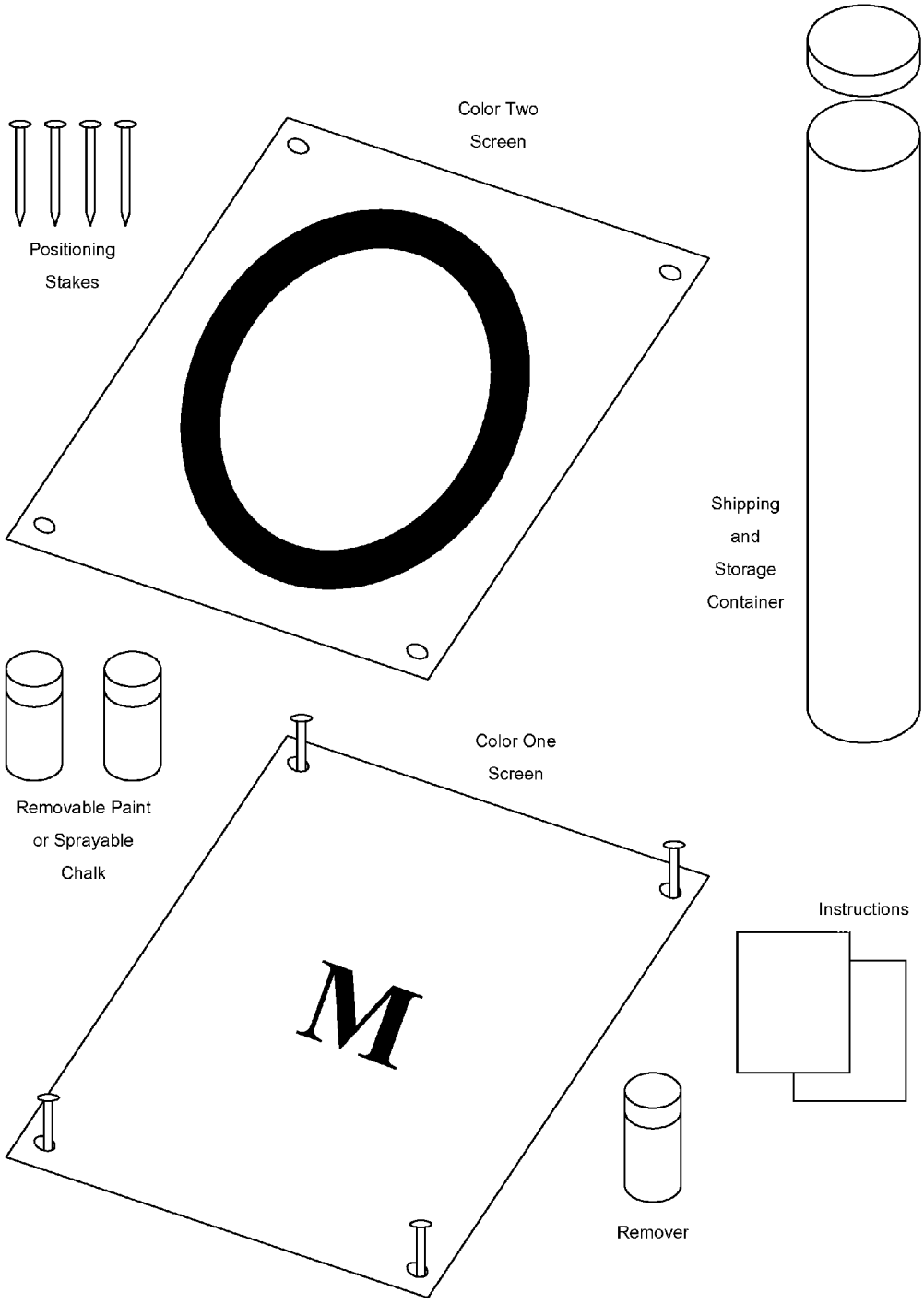
Color Two
Screen
Positioning
Stakes
Shipping
and
Storage
Container
Removable Paint
or Sprayable
Chalk
Color One
Screen
M
Instructions
Remover

SCREEN PRINTING METHOD FOR APPLYING A DESIGN ON A GROUND SURFACE

CROSS-REFERENCE TO RELATED APPLICATIONS

This application claims priority to U.S. Provisional Patent Application Ser. No. 60/790,898 filed Apr. 11, 2006 and U.S. Non-Provisional Application Ser. No. 11/607,755 entitled "Screen Printing System and Method" filed Nov. 30, 2006, which are incorporated by reference in its entirety as if fully set forth herein.

TECHNICAL FIELD

The described systems, methods and kits are generally related to screen printing decorations onto a variety of indoor and outdoor surfaces.

BACKGROUND

Garments and certain other items, such as T-shirts, sweat shirts, hats and towels, may be decorated using screen printing machines having one or more printing heads. Generally, the number of heads correspondence to the number of colors to be printed. Applying a screen print to a traditional cloth surface typically involves the development of a positive image onto a screen for each color to be applied to the surface of that item. Typically such screens will be a nylon mesh with a mesh count of approximately 80 or more units per inch, and an image is applied to the screen using an emulsion which is spread onto the screen and selectively exposed to UV light to solidify or burn the image onto the screen mesh.

Each color of an image has its own screen through which an ink or paint is forced to leave an imprint on the item being printed. Each screen is usually stretched taught and attached to a frame which in turn is attached to a screen printing machine or apparatus with single or multiple screen heads. The item on which a decoration is to be printed is fixed to a pallet or surface and a single color screen is brought down and positioned onto the surface of the item to be decorated. A second and subsequent colors may be added to the item being printed on by repeating the process. Each subsequent color may overlay any previous colors.

Traditional applications of designs or logos to an outdoor surface such as grass, asphalt, concrete or other similar surfaces utilize large stencils. A stencil for this type of applications is usually a large single sheet of plastic with a perforated outline cut into the plastic. Typically, the single sheet includes perforated outlines for all colors to be used in the design. Once the perforated outline is traced with the paint for each separate color, of which, all are on the same sheet of plastic, the plastic is removed and the outline is completed for each color by connecting the dots. Then each area of color must be filled in with paint to complete the design or logo using the outline colors as a guide.

BRIEF DESCRIPTION OF THE DRAWINGS

A more complete appreciation of the invention and many of the attendant advantages thereof may be readily obtained by reference to the following detailed description when considered with the accompanying drawings, wherein:

The FIGURE is a plan view of certain elements of one embodiment of the present invention.

DETAILED DESCRIPTION

A unique screen painting process and kit for lawn, grassy area, driveway, or other indoor and outdoor surfaces is described. The screen printing kit enables a user to employ the screen printing process to decorate a non-traditional surface, where a cumbersome and complicated stencil was used before. The screen printing process is intended to create a more simplistic format for the general consumer in which to apply and remove a single or multi color design or logo to an outdoor or other non-traditional surface.

One example kit comprises:

Shipping and storage tube, container or carton;

Single or multiple screens with grommets;

Four (4) stakes;

Single or multiple case of color application;

Color remover; and

Instructions.

The single or multiple screens of the kit are imprinted to facilitate depiction of a particular design or logo and may be embodied in any of a variety of screen formats, such as small-format or large-format. Formats as large or larger than 36 inches by 36 inches may be utilized for certain outdoor applications. In one example embodiment, the screens are manufactured from PVC, and the screens have a mesh count of 14×18 or 16×18 per square inch. The production of each screen may include mounting each screen in a frame and imprinting the screen with the desired design. In one example embodiment, imprinting the screen with the desired design includes cutting an image of the desired design from a sheet of vinyl and applying the cut vinyl sheet to the screen using glue, heat or another known means of adhesion. Once imprinted with the desired design, the screen is removed from its frame, and a grommet may be placed in each corner of the screen or screens.

The screens are then placed in the shipping and storage container such as a tube, along with the specific color application, optional color remover, stakes and instructions. Examples of the color application include but are not limited to removable paint, permanent paint, water sprayable chalk and semi-permanent sprayable chalk. In one example embodiment, the color application may be a paint which may be chemically removed using a corresponding paint remover. In another example embodiment, the color application may be a temporary paint which may be washed away with soap and water or water alone.

Regarding an example application process, the consumer selects the type of surface on which to place the design or logo. Preferably, the surface is clean and free of debris. If the surface is grass, it is preferred that it be cut short. On a hard surface such as a concrete and asphalt may be improved if the area is swept clean.

In an example application process in which paint is used as the color application, each screen is unrolled and laid out on a flat surface. The screens may be numbered to indicate an order of use. It is envisioned that in one embodiment, each screen will correspond to a distinct color. In other embodiments, multiple colors may be applied through a common screen where the design does not require colors to touch or overlap.

The first screen is laid on the area in which the design and logo is to be placed. With the 4 stakes, the screen may be stretched and the stakes placed through the 4 grommet holes and into the groups to hold the screen firmly in place.

A first can of removable paint may be used to apply a first color associated with the current screen and design or logo.

The paint is sprayed through the mesh of the first screen, applying coloring evenly until the area is completely covered.

Leaving the stakes in place, the first is removed and replaced with the second screen using the stakes to position the second screen in alignment with the area to display the logo. A user repeats this process until all colors of the design have been painted. Once the final screen is removed, the design or logo is complete.

The design or logo will remain on the surface as long the color application lasts or as long as desired. The logo may be removed with the application of the remover.

The user applies the remover liberally. In embodiments in which the remover is paint remover, the user may agitate with a broom and wash away with water such as from a garden hose. If residue remains the process may be repeated.

Of course, there are various other ways to remove a logo or design. For example, in cases where the logo has been applied to an area of grass, the grass may be allowed to grow out and may be cut with a mover, to remove the design or logo.

From the above description, including the attached drawing FIGURE, those skilled in the art will perceive improvements, changes and modifications in the described methods and systems. Such improvements, changes and modifications within the skill of the art are intended to be covered by the present application.

Accordingly, it is to be understood that the drawings and description in this disclosure and proffered to facilitate comprehension of the methods, systems and apparatus, and should not be construed to limit the scope thereof. It should be understood that various changes, substitutions and alterations case be made without departing from the spirit and scope of the disclosure.

What is claimed is:

1. A method for applying a design on a surface, comprising:

laying out a first screen on a ground surface, the first screen comprising a first layer comprising a PVC mesh having a mesh count of 14×18 per square inch and a second vinyl layer adhered to and at least partially covering the first layer, thereby being imprinted with a first design, the first screen further comprising at least one grommet;

securing the first screen to the ground surface using the at least one grommet;

applying a first color to the ground surface through the first screen; and removing the first screen.

2. The method of claim 1 further comprising:

laying out a second screen on a ground surface, the second screen comprising a first layer comprising a PVC mesh having a mesh count of 14×18 per square inch and a second vinyl layer adhered to and at least partially covering the first layer, thereby being imprinted with a second design, the second screen further comprising at least one grommet;

securing the second screen to the ground surface using the at least one grommet;

applying a second color to the ground surface through the second screen; and removing the second screen.

3. The method of claim 1 further comprising stretching the first screen before securing the first screen to the ground surface.

4. The method of claim 1 wherein:

the screen includes at least one grommet for receiving a stake; and the step of securing includes driving stakes into the ground surface.

5. The method of claim 1 wherein the first color is a removable paint.

6. The method of claim 1 wherein the first color is a washable paint.

7. The method of claim 1 wherein the first color is a permanent paint.

* * * * *